US006078248A

United States Patent [19]

Yagi

[11] Patent Number: 6,078,248

[45] Date of Patent: Jun. 20, 2000

[54] ROTARY MANIPULATION TYPE VARIABLE RESISTOR AND METHOD OF MANUFACTURING THE SAME

[75] Inventor: Yoshikazu Yagi, Tsuyama, Japan

[73] Assignee: Matsushita Electric Industrial Co., Ltd., Osaka, Japan

[21] Appl. No.: 09/321,580

[22] Filed: May 28, 1999

[30] Foreign Application Priority Data

Jun. 1, 1998 [JP] Japan ..... 10-150995

[51] Int. Cl.[7] ..... H01C 10/32

[52] U.S. Cl. ..... 338/174; 338/162; 338/188

[58] Field of Search ..... 338/162, 163, 338/171, 174, 188, 190, 192

[56] References Cited

U.S. PATENT DOCUMENTS

| | | | |
|---|---|---|---|
| 2,736,783 | 2/1956 | Daily | 338/174 |
| 2,958,839 | 11/1960 | Barden | 338/174 |
| 3,421,133 | 1/1969 | Van Beuthuysen | 338/174 |
| 3,947,800 | 3/1976 | Benthuysen et al. | 338/163 |
| 3,965,454 | 6/1976 | Puerner | 338/174 |
| 4,246,565 | 1/1981 | Wiley et al. | 338/163 |
| 4,309,690 | 1/1982 | Shoji et al. . | |
| 4,429,297 | 1/1984 | Nakatsu . | |
| 4,430,634 | 2/1984 | Hufford et al. . | |
| 4,477,795 | 10/1984 | Henmi et al. | 338/163 |
| 4,479,106 | 10/1984 | Shimizu et al. | 338/174 |
| 4,565,990 | 1/1986 | Matsui et al. . | |
| 4,821,014 | 4/1989 | Masuda et al. . | |
| 4,914,417 | 4/1990 | Matsui et al. . | |
| 5,095,298 | 3/1992 | Chapman et al. . | |
| 5,525,956 | 6/1996 | Hashizume et al. | 338/162 |

*Primary Examiner*—Karl Easthom
*Attorney, Agent, or Firm*—McDermott, Will & Emery

[57] ABSTRACT

In spite of small size, a rotary manipulation type variable resistor capable of preventing electromigration when used in direct-current electric field is obtained. Moreover, the process of forming the case while inserting the resistance substrate and current collector is simplified. It includes a resistance element layer disposed on a first insulating substrate, a conductive layer disposed on a second insulating substrate, and a slider having a first contact point contacting with the surface of the resistance element layer and a second contact point contacting with the surface of the conductive layer. The conductive layer is a printed layer containing conductive powder and binder, and the surface of the resistance element layer and the surface of the conductive layer are positioned mutually at a step.

4 Claims, 5 Drawing Sheets

ROTARY MANIPULATION TYPE VARIABLE RESISTOR AND METHOD OF MANUFACTURING THE SAME

FIELD OF THE INVENTION

The present invention relates to a rotary manipulation type variable resistor and a method of manufacturing the same.

BACKGROUND OF THE INVENTION

Recently electronic appliances are promoted in the trend of downsizing to be used as portable units or to concentrate multiple functions. The variable resistors used in such small-sized electronic appliances are also demanded to be reduced in size.

Moreover, along with wide distribution of IC, microcomputers and the like, variable resistors are more often used as means for adjustment of direct-current voltage.

In variable resistors in such conditions, troubles due to electromigration are likely to occur. To prevent such troubles, the following measures have been attempted. To begin with, electromigration is a phenomenon of ions moved by an electric field. For example, in an electronic circuit, ion components generated from the conductor depending on the environments of use move toward other conductor having a different potential, and, as a result, a defective portion of electric insulation is formed.

A prior art of this kind in a small-sized rotary manipulation type variable resistor is described while referring to the drawings.

FIG. 8 is a side sectional view of a conventional rotary manipulation type variable resistor, FIG. 9 is a perspective appearance of a resistance substrate shown in FIG. 8, and FIG. 10 is a perspective appearance of a current collector shown in FIG. 8. In FIG. 8, a conventional rotary manipulation type variable resistor comprises a case 1, a resistance substrate 3 having a resistance element layer 2, a current collector 4, a slider 7, and a manipulation knob 6. The case 1 is made of an insulating resin, and is formed like a box, having an opening portion in the upper side and a small penetration hole 1A in the center.

The resistance substrate 3 is a hard electric insulating substrate. The resistance element layer 2 is formed on the surface of the resistance substrate 3 by printing, and is formed like a horseshoe. The resistance substrate 3 having the resistance element layer 2 has a circular hole 3A formed in the center of the resistance element layer 2. The current collector 4 is a circular metal plate, and a small circular hole 4A is formed in its center. The current collector 4 is overlaid and disposed beneath the resistance substrate 3 so as to be concentric with the circular hole 3A.

Connection portions 2A, 2B are disposed at both ends of the horseshoe resistance element layer 2. The connection portions 2A, 2B are formed by printing by using silver ink. Terminals 5A, 5B are crimped to the connection portions 2A, 2B. A terminal 4B is integrally formed on the current collector 4. Each one of the terminals 5A, 5B and terminal 4B is disposed so as to project outward of the case 1.

The case 1 is formed and fabricated in a state of inserting the resistance substrate 3 having the resistance element layer 2 and the current collector 4, and at the same time the small penetration hole 1A is formed in the center. Thus, the resistance substrate 3 and current collector 4 are fixed, and the case 1 having the small penetration hole 1A is formed.

The manipulation knob 6 is disposed to cover the opening of the case 1, and it is made of insulating resin and is designed to be manipulated by rotation. The manipulation knob 6 has an anti-slip protrusion 6A and a shaft 6B formed in the lower part of the center. The slider 7 made of an elastic thin metal plate is held at the lower side of the flat plate of the manipulation knob 6. The anti-slip protrusion 6A and shaft 6B are passed in the small penetration hole 1A, so that the manipulation knob 6 is held rotatably in the case 1. An elastic contact point 7A elastically contacts with the resistance element layer 2, and an elastic contact point 7B elastically contacts with the current collector 4. To stabilize the contact, silver plating is applied on the contact surface of the current collector 4 at the contact portion of two metal plates. Further, to prevent damage of surface due to seizure by rotation and sliding, contact point grease of low viscosity is applied on the contact surface of the current collector 4.

In thus constituted rotary manipulation type variable resistor, by applying a force on the outer circumference 6C of the manipulation knob 6 in the tangential direction, the manipulation knob 6 is rotated, and the elastic contact point 7A of the slider 7 elastically slides on the resistance element layer 2, and the elastic contact point 7B elastically slides on the current collector 4. Thus, the resistance value between the terminal 5A and terminal 4B, or between the terminal 5B and terminal 4B is changed.

In the rotary manipulation type variable resistor having such constitution, electromigration of silver ions may occur. The location is the point of occurrence of potential difference due to presence of silver. Positions corresponding to this condition are (A) and (B):

(A) The area between connection portion 2A and connection portion 2B at both ends of the resistance element layer 2 in which silver ink is printed on the resistance substrate 3.

(B) The area between the silver plated current collector 4 and the resistance element layer 2.

To prevent electromigration in these areas, a sufficiently long spacing is provided between the connection portion 2A and connection portion 2B at both ends of the resistance element layer 2. Moreover, as the current collector 4 is disposed beneath the resistance substrate 3, a spacing corresponding to the plate thickness of the resistance substrate 3 is provided between the current collector 4 and resistance element layer 2. Therefore, electromigration has been prevented in these areas (A) and (B).

However, in such conventional rotary manipulation type variable resistor, the current collector 4 and resistance substrate 3 are composed by using mutually different materials. Accordingly, by using an insulating resin, when forming and processing the case 1 while inserting the current collector 4 and resistance substrate 3, the manufacturing process was complicated. It was also required to apply a contact grease on the contact surfaces of the current collector 4 and elastic contact point 7B. Still more, the contact grease may be adhered to the resistance element layer 2, and the resistance element layer 2 may be damaged by the elastic contact point 7A.

It is hence an object of the invention to present a rotary manipulation type variable resistor free from occurrence of migration even in the state of use in direct current, easy in manufacturing process, not requiring application of contact grease on contact surface of elastic contact point, and capable of reducing in size.

SUMMARY OF THE INVENTION

A rotary manipulation type variable resistor of the invention comprises:

(a) a resistance substrate having a first insulating substrate, a horseshoe resistance element layer, and a first connection portion and a second connection portion disposed at each of both ends of the resistance element layer, in which the horseshoe resistance element layer, and the first connection portion and the second connection portion are disposed on a first insulating substrate, the resistance substrate has a first circular notch formed in the center and a notch formed between the first connection portion and second connection portion, the notch reaches from the first circular notch to the outer circumference of the resistance substrate, the resistance element layer is a first printing layer, and each one of the first connection portion and second connection portion is a second printing layer containing silver, (b) a current collector having a circular conductive layer, and a band conductive layer formed consecutively to the circular conductive layer, in which the current collector is disposed on a second insulating substrate, the current collector has a second circular notch formed in the center, each one of the circular conductive layer and band conductive layer is a third printing layer containing silver powder and binder, and the circular conductive layer of the current collector and the resistance element layer of the resistance substrate is disposed mutually at a step, (c) a first terminal connected to the first connection portion, a second terminal connected to the second connection portion, and a third terminal connected to the band conductive layer, (d) a case accommodating the resistance substrate and current collector, in which the case has an opening and a penetration hole, the resistance element layer and the circular conductive layer is exposed in the case, and each end of the first terminal, the second terminal and the third terminal projects from the side face of the case, (e) a manipulation knob disposed to cover the opening, in which the manipulation knob has a flat part and a shaft projecting from the center of the flat part, and the shaft is inserted into the penetration hole, and (f) a slider having a first contact point and a second contact point disposed on the flat part of the manipulation knob, in which the first contact point may be sliding on the surface of the resistance element layer while contacting with the resistance element layer, and the second contact point may be sliding on the surface of the circular conductive layer while contacting with the circular conductive layer.

A manufacturing method of a rotary manipulation type variable resistor of the invention comprises:

(a) a step of preparing a first ink containing conductive powder and binder, (b) a step of preparing a second ink containing resistance material, (c) a step of forming a resistance element layer by printing the second ink on an insulating substrate, (d) a step of forming a conductive layer by printing the first ink on the insulating substrate, (e) a step of preparing a current collector having the conductive layer and a resistance substrate having the resistance element layer, by blanking the insulting substrate forming the conductive layer and the resistance element layer, and (f) a step of preparing a case by forming an electric insulating resin, while inserting the current collector and the resistance substrate, so that the surface of the conductive layer and the surface of the resistance element layer may be positioned at a position mutually having a step.

The current collector and the resistance substrate are separated from each other. The current collector and resistance substrate have a step without being separated from each other. With the surface of the conductive layer and the surface of the resistance element layer being exposed in the same direction in the case, the current collector and the resistance substrate are fixed in the case.

Preferably, the constitution is composed as follows.

The resistance element layer has a horseshoe shape, and the conductive layer has a circular conductive layer of a smaller outside diameter than the inside diameter of the horseshoe resistance element layer.

The method includes a step of printing and forming a first connection portion connected to the end of the horseshoe resistance element layer and a second connection portion connected to other end, and a step of printing and forming a band conductive layer connected to the circular conductive layer.

Step (f) further includes a step of crimping and connecting a first terminal to the first connection portion, crimping and connecting a second terminal to the second connection portion, and crimping and connecting a third terminal to the band conductive layer.

The leading ends of the first terminal, second terminal and third terminal project from the case to the outside.

The conductive powder is silver powder.

In this constitution, if used in direct current, electromigration does not occur. It is not necessary to apply contact grease on the contact surface of the elastic contact point. It is possible to reduce in size.

REFERENCE NUMERALS

Figure 1:
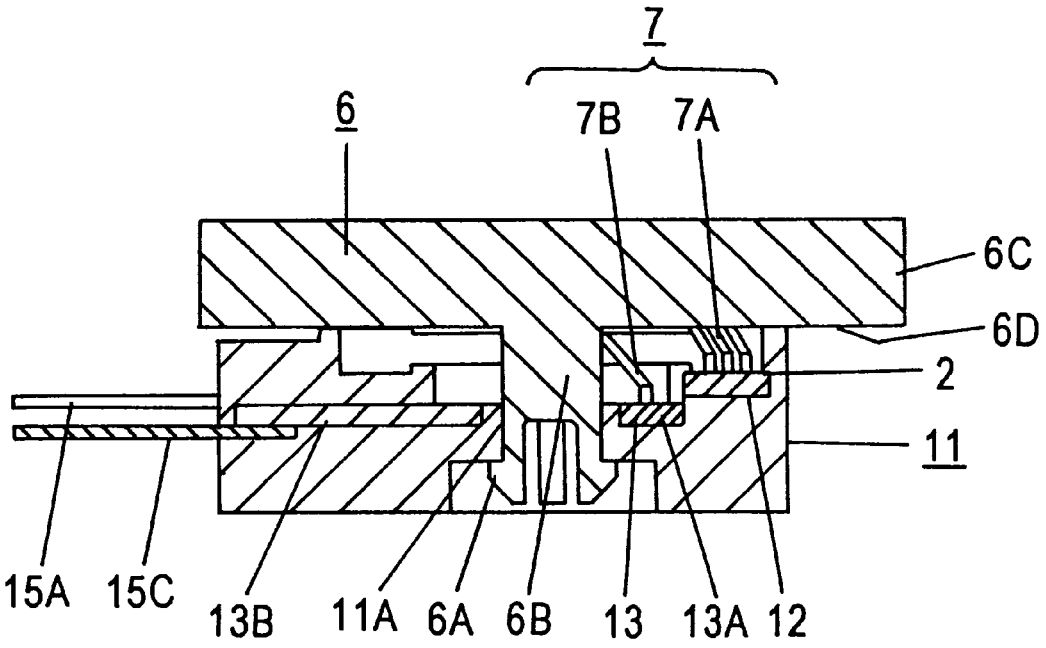
FIG. 1 is a side sectional view of a rotary manipulation type variable resistor in a first embodiment of the invention.

2 Resistance element layer
2A First connection portion
2B Second connection portion
6 Manipulation knob
6A Anti-slip protrusion

6B Shaft
6C Outer circumference
6D Flat part
7 Slider
7A First contact point
7B Second contact point
11 Case
11A Penetration hole
12 Resistance substrate
12A Notch
12D First circular notch
13 Current collector
13A Circular conductive layer (current collecting layer)
13B Band conductive layer
13D Second notch
14 Coupling beam
15 Terminal block
15A First terminal
15B Second terminal
15C Third terminal
16 Band coupling beam
17 Case
18 Resistance substrate
18A Blanking hole
19 Current collector
20 Terminal block
20A First terminal
20B Second terminal
20C Third terminal
30 Insulating substrate
31 Insulating substrate

DETAILED DESCRIPTION OF THE INVENTION

A rotary manipulation type variable resistor in an embodiment of the invention comprises:

(a) a resistance substrate including a first insulating substrate, and a horseshoe resistance element layer, a first connection portion and a second connection portion disposed at both ends of the resistance element layer, in which the horseshoe resistance element layer, the first connection portion and the second connection portion are disposed on the first insulating substrate, (b) a current collector including a second insulating substrate, and a circular conductive layer and a band conductive layer formed consecutively to the circular conductive layer, disposed on the second insulating substrate, (c) a first terminal connected to the first connection portion, a second terminal connected to the second connection portion, and a third terminal connected to the third connection portion, (d) a case accommodating the resistance substrate and current collector, and having an opening and a penetration hole, (e) a manipulation knob disposed to cover the opening, and (f) a slider having a first contact point and a second contact point disposed on the flat part of the manipulation knob.

The resistance substrate has a first circular notch formed in the center, and a notch formed between the first connection portion and the second connection portion.

The notch reaches from the first notch to the outer circumference of the resistance substrate.

The current collector has a second notch formed in the center

The circular conductive layer is a printed layer containing conductive powder and binder.

The circular conductive layer of the current collector and the resistance element layer of the resistance substrate are mutually disposed at a step. The resistance element layer and the circular conductive layer are exposed in the case.

Each end of the first terminal, second terminal and third terminal is projecting from the outside of the case.

The manipulation knob has a flat part and a shaft projecting from the center of the flat part.

The shaft is inserted into the penetration hole.

The first contact point is capable of sliding on the surface of the resistance element layer, while contacting with the resistance element layer.

The second contact point is capable of sliding on the surface of the circular conductive layer, while contacting with the circular conductive layer.

The circular conductive layer of the current collector is positioned at the lower side of the first notch of the resistance element, and the band conductive layer is positioned at the lower side of the notch.

The conductive powder is silver powder.

The first connection portion, second connection portion, and band conductive layer are printed layers containing silver.

The resistance element layer, first connection portion, second connection portion, circular conductive layer, and band conductive layer are printed layers.

At least one connection selected from the group consisting of connection between the first terminal and first connection portion, connection between the second terminal and second connection portion, and connection between the third terminal and band conductive layer is connection by crimping.

The case is an insert molding integrally molding the resistance substrate and current collector.

In this constitution, it is possible to realize a rotary manipulation type variable resistor of small size, free from migration if used in direct current, and not requiring application of contact grease on the contact surface of elastic contact point.

A manufacturing method of a rotary manipulation type variable resistor in an embodiment of the invention comprises:

(a) a step of printing and forming conductive layers, such as a horseshoe resistance element layer, connection portions at both ends thereof, a circular current collecting layer having a smaller outside diameter than the inside diameter of the resistance element layer, and band conductive layer formed as being connected to this circular current collecting layer, on a hard insulating substrate, (b) a step of fabricating a current collector having a circular current collecting layer and a band protrusion, and a resistance substrate having a resistance element layer and both connection portions, by blanking the insulating substrate forming the conductive layer, (c) a step of crimping and connecting terminals to both connection portions of the resistance substrate and band leading end of the current collector, and (d) a step of inserting, molding and fixing the resistance substrate and current collector on the bottom of the box-shaped case made of insulating resin, so that the terminals may project outward and that the current collector surface may be lower than the resistance substrate surface.

In this constitution, the resistance substrate and the current collector can be printed and processed at the same time. By crimping connection of terminals, the resistance substrate and current collector can be formed of a same insulating substrate. As a result, the material cost and the processing cost may be lowered, and the step between the resistance substrate surface and the current collector surface may be set freely.

A manufacturing method of the rotary manipulation type variable resistor in an embodiment also includes a step of processing while temporarily coupling the resistance substrate and current collector, without separating completely, with the current collector portion depressed with a step into the blanking hole of the resistance substrate, when forming the current collector having the circular current collecting layer and band conductive layer, and the resistance substrate having the resistance element layer and both connection portions. The same effects as above are obtained in this constitution. Further, the resistance substrate and current collector can be handled as an integral component, position deviation does not occur between the two, so that the case inserting, molding and fixing the resistance substrate and current collector at high precision can be easily formed.

Other manufacturing method of rotary manipulation type variable resistor of the invention comprises a step of crimping and connecting both connection portions of the resistance substrate and band conductive layer of the current collector to the terminal block consisting of three terminals having the leading ends coupled at a specified interval by the coupling beams, a step of inserting, molding and fixing the resistance substrate and current collector into the bottom of the case made of insulating resin, while maintaining the resistance substrate and current collector in a specified configuration, and a step of cutting off and separating the coupling beams at the terminals ends after inserting and molding.

A different manufacturing method of rotary manipulation type variable resistor of the invention comprises a step of crimping and connecting the resistance substrate and current collector consecutively to the terminal hoop having terminal blocks provided consecutively at specified intervals in long coupling beams, and a step of inserting, molding and processing the case consecutively.

In this constitution, the case can be molded and processed continuously and efficiently. Moreover, by using this, the entire rotary manipulation type variable resistor can be assembled continuously and automatically.

Referring now to the drawings, preferred embodiments of the invention are described below while referring to the accompanying drawings.

The same constituent parts as explained in the prior art are identified with same reference numerals, and duplicate description is omitted.

EXEMPLARY EMBODIMENT 1

Figure 2:
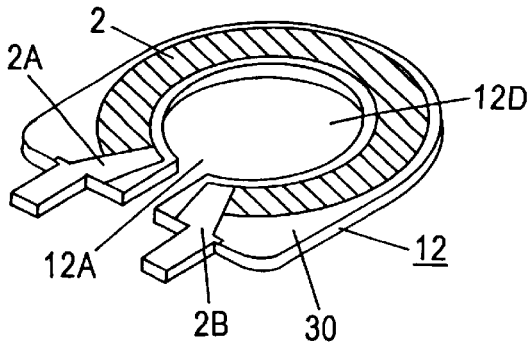
FIG. 2 is a perspective appearance of a resistance substrate composed in the variable resistor shown in FIG. 1.
Figure 3:
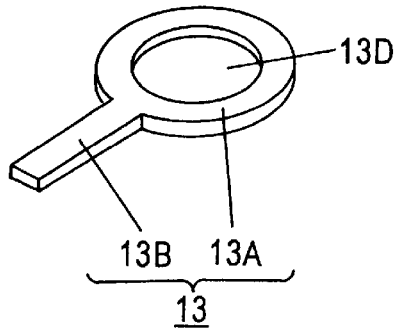
FIG. 3 is a perspective appearance of a current collector composed in the variable resistor shown in FIG. 1.

FIG. 1 is a side sectional view of a rotary manipulation type variable resistor in a first embodiment of the invention. FIG. 2 is a perspective appearance of a resistance substrate composed in the variable resistor shown in FIG. 1. FIG. 3 is a perspective appearance of a current collector composed in the variable resistor shown in FIG. 1.

In FIGS. 1, 2, and 3, the rotary manipulation type variable resistor comprises a case 11, a resistance substrate 12 having a resistance element 2, a current collector 13, a slider 7, and a manipulation knob 6.

The rotary manipulation type variable resistor is manufactured in the following process.

(a) A first ink containing conductive material such as silver powder is prepared. Further, a second ink containing resistance material such as carbon powder is prepared. The first ink and second ink are printed in a specified shape on the surface of an insulating substrate 30. The first ink contains silver, powder for heightening the film hardness, and thermosetting resin as binder. The second ink contains carbon powder, powder for heightening the film hardness, and thermosetting resin as binder. The second ink containing carbon forms a horseshoe resistance element layer 2. The first ink containing silver forms a first connection portion 2A and a second connection portion 2B connected at both ends of the resistance element layer 2, a circular conductive layer 13A formed inside of the resistance element layer 2, and a band conductive layer 13B connected to the circular conductive layer 13A. The applied inks are then cured. Thus, the horseshoe resistance element 2, first connection portion 2A and second connection portion 2B connected at both ends of the resistance element layer 2, circular conductive layer 13A formed inside of the resistance element layer 2, and band conductive layer 13B connected to the circular conductive layer 13A are formed. The circular conductive layer 13A plays a role as a current collecting layer. The resistance element layer 2 contains carbon, while the first connection portion 2A, second connection portion 2B, circular conductive layer 13A and band conductive layer 13B contain silver. As the conductive material, silver is most preferred, but other metal powder or alloy powder may be also used. As the resistance material, carbon is most preferred, but other conductive powder may be also used. In this case, the circular conductive layer 13A is printed with a slight gap to the horseshoe resistance element layer 2, and the band conductive layer 13B is printed with a slight gap between the first connection portion 2A and second connection portion 2B. Thus, the conductive layer is formed.

(b) Later, the insulating substrate 30 having these conductive layers is blanked, and the resistance substrate 12 as shown in FIG. 2 and the current collector 13 as shown in FIG. 3 are fabricated. The resistance substrate 12 includes the horseshoe resistance element layer 2, and a conductive layer having the first connection portion 2A and second connection portion 2B connected to both ends of the resistance element layer 2. Further, the resistance substrate 12 includes a first circular notch 12D formed in the center, and a notch 12A reaching from this first circular notch 12D to the outer circumference through the space between the first connection portion 2A and second connection portion 2B. On the other hand, the current collector 13 includes conductive layers having a circular conductive layer 13A, and a band conductive layer 13B connected to this circular conductive layer 13A. The current collector 13 also has a second notch 13D formed in the center.

Figure 4:
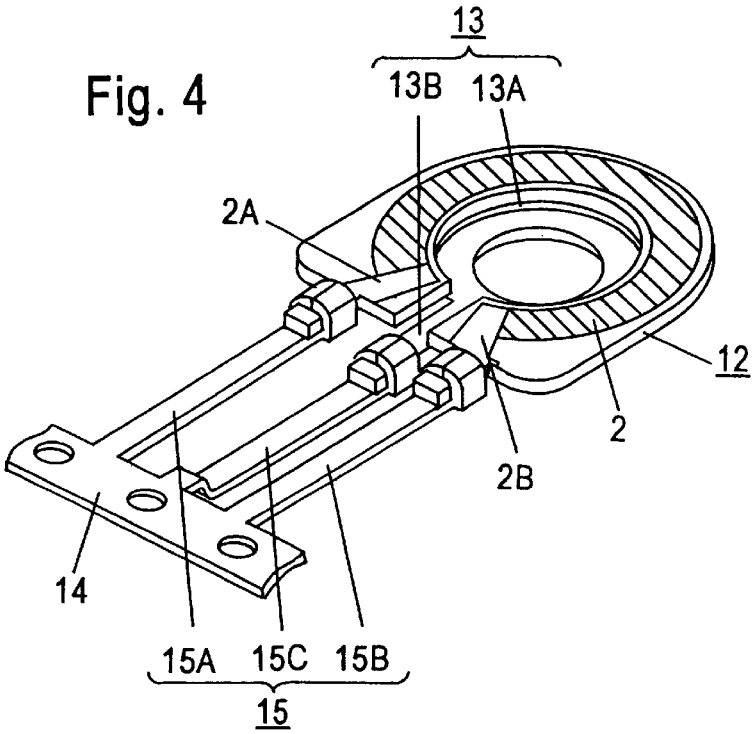
FIG. 4 is a perspective appearance of the resistance substrate and current collector before being inserted, formed and fixed.

(c) As shown in FIG. 4, consequently, the ends of the first connection portion 2A and second connection portion 2B of the resistance substrate 12, and the band conductive layer 13B of the current collector 13 fabricated by blanking are bonded to the coupling beam 14. That is, the coupling beam 14 has a terminal block 15 having a first terminal 15A, a second terminal 15B, and third terminal 15C having the leading end portions coupled at specified intervals. The end of the first connection portion 2A is crimped and connected to the first terminal 15A, the end of the second connection portion 2B is crimped and connected to the second terminal 15B, and the end of the band conductive band 13B is crimped and connected to the third terminal 15C.

(d) Afterwards, the resistance substrate 12 and current collector 13 are disposed in a complementary form so that the position of the current collector 13 may coincide with the notch 12A and that the upper surface of the current collector 13 may be lower than the upper surface of the resistance substrate 12, and the case 11 is inserted and molded by using resin. Thus, the inserted molding of the case 11 and the resistance substrate 12 and current collector 13 fixed in the bottom of the case 11 is fabricated. In thus prepared inserted molding, the resistance element layer 2 and circular conductive layer 13A are exposed to the inner bottom of the case 11 at a specified step. Also in this inserted molding, the terminal block 15 is exposed to project outward of the case 11. The case 11 has a penetration hole 11A running through the second circular notch 13D, and an opening formed in the upper surface. At this step, meanwhile, the resistance substrate 12 and current collector 13 may be also disposed so that the upper surface of the current collector 13 may be higher than the upper surface of the resistance substrate 12. Most preferably, the current collector 13 and the resistance element 12 may be disposed so that their upper surfaces may be formed mutually at a specific step.

(e) The first terminal 15A, second terminal 15B, and third terminal 15C are cut off and separated from each other. Thus is fabricated the case 11 fixing the resistance element layer 2 having the first terminal 15A and second terminal 15B, and the current collector 13 having the third terminal 15C.

(f) To cover the opening of the case 11 formed in this manner, a manipulation knob 6 made of insulating resin is disposed. This manipulation knob 6 has a anti-slip protrusion 6A and a shaft 6B formed beneath the center, and a flat part 6D. Moreover, a slider 7 including a first elastic contact point 7A and a second elastic contact point 7B is placed in the flat part 6D. The slider 7 is made of an elastic metal thin plate. The anti-slip protrusion 6A and shaft 6B are inserted in the penetration hole 11A, and the manipulation knob 6 is rotatably held in the case 11. At this time, the first elastic contact point 7A elastically contacts with the surface of the resistance element layer 2, and the second elastic contact point 7B elastically contacts with the surface of the circular conductive layer 13A.

Thus, the rotary manipulation type variable resistor is prepared.

In thus constituted rotary manipulation type variable resistor, by applying a force to the outer circumference 6C of the manipulation knob 6 in the tangential direction, the manipulation knob 6 is rotated. The first elastic contact point 7A of the slider 7 elastically slides on the surface of the resistance element layer 2, and the second elastic contact point 7B elastically slides on the surface of the current collector 13. In this way, the resistance value is varied respectively between the first terminal 15A and third terminal 15C, and between the second terminal 15B and third terminal 15C.

Thus, according to the embodiment, if the hard insulating substrate 30 to be used is thin, the position of the resistance substrate 12 and current collector 13 may be easily determined securely by the terminal block 15. It is therefore possible to set freely the step between a surface of the resistance substrate 12 and a surface of the current collector 13. Hence, a sufficient spacing may be provided in the portion having a potential difference from the printed portion of the first ink containing silver. As a result, even when used in the direct-current electric field, generation of electromigration can be prevented. That is, it is possible to prevent occurrence of electromigration of silver ions between the resistance element layer 2 and circular conductive layer 13A, first connection portion 2A and second connection portion 2B, and band conductive layer 13B, first connection portion 2A and second connection portion 2B. Therefore, occurrence of defective insulation between conductive layers is prevented. As a result, a variable resistor having an excellent reliability is obtained. Since the resistance substrate 12 and current collector 13 are manufactured by using the same insulating substrate 30 and in the simultaneous printing process, the material cost and processing cost are saved.

Moreover, since the terminals are connected by crimping, the material cost and processing cost are also saved.

The conductive layers prepared by the first ink and second ink have excellent film strength and smoothness. Accordingly, the surfaces of the resistance element layer 2 and circular conductive layer 13A are hardly damaged by the slider 7. It is hence not necessary to apply contact grease on the contact surface of the first elastic contact point 7A and resistance element layer 2, or the contact surface of the second elastic contact point 7B and the circular conductive layer 13A.

Figure 5:
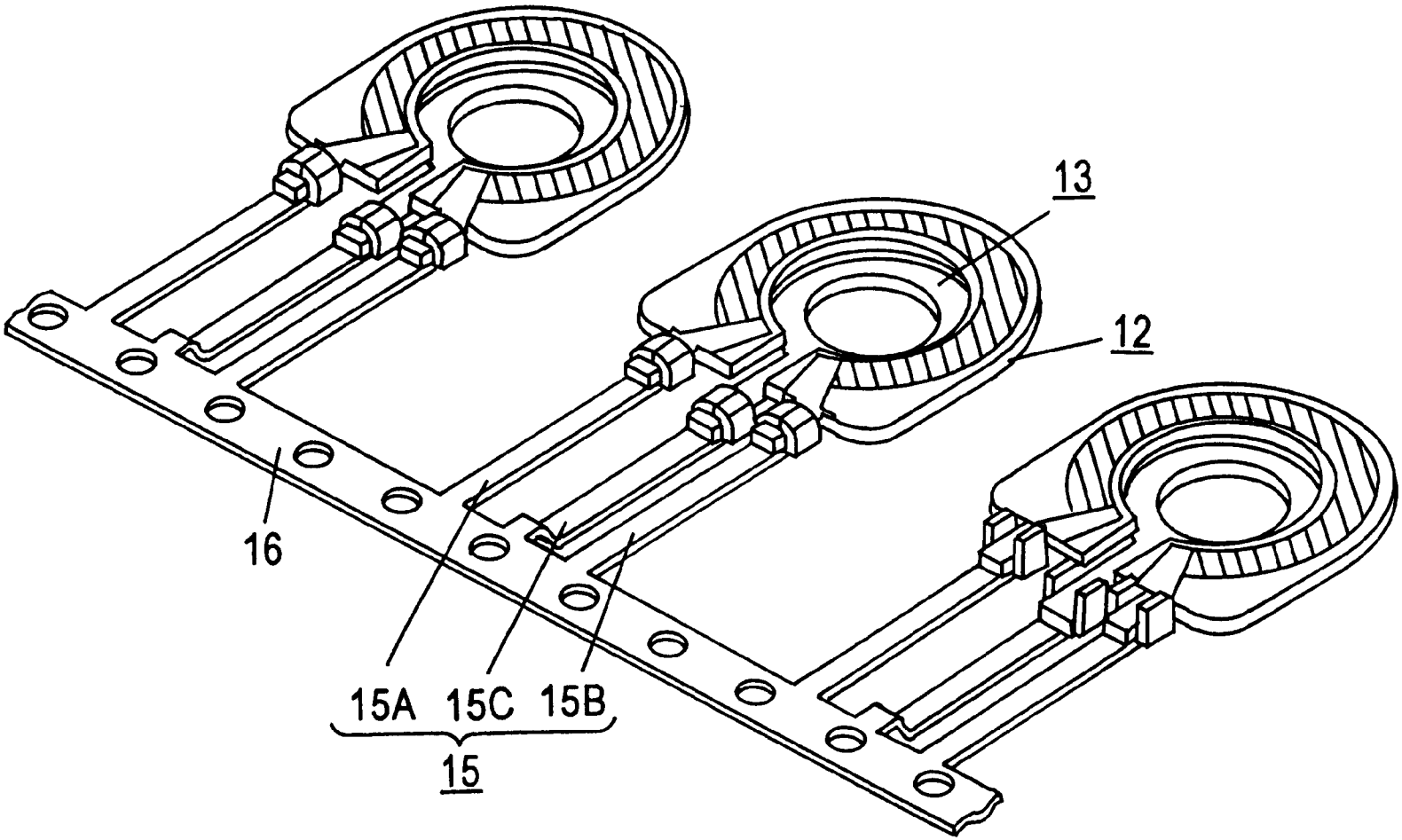
FIG. 5 is a perspective appearance showing a state of crimping and connecting the resistance substrate and current collector consecutively to a terminal hoop.

In the embodiment, as shown in FIG. 5, a plurality of terminal blocks 15 having the first terminal 15A, second terminal 15B and third terminal 15C may be also formed consecutively at specific intervals on a long band coupling beam 16. That is, the terminal hoop has a band coupling beam 16 and a plurality of terminal blocks 15 formed integrally in the band coupling beam 16, and each one of the plurality of terminal blocks 15 has the first terminal 15A, second terminal 15B, and third terminal 15C. To the first terminal 15A, second terminal 15B, and third terminal 15C, the resistance substrate 12 and current collector 13 are continuously crimped and connected. Afterwards, insert molding process is executed continuously, and the case 11 is fabricated. In this method, the molding process efficiency of the case 11 is enhanced. By utilizing this method, the entire rotary manipulation type variable resistor may be easily assembled continuously and automatically.

EXEMPLARY EMBODIMENT 2

Figure 6:
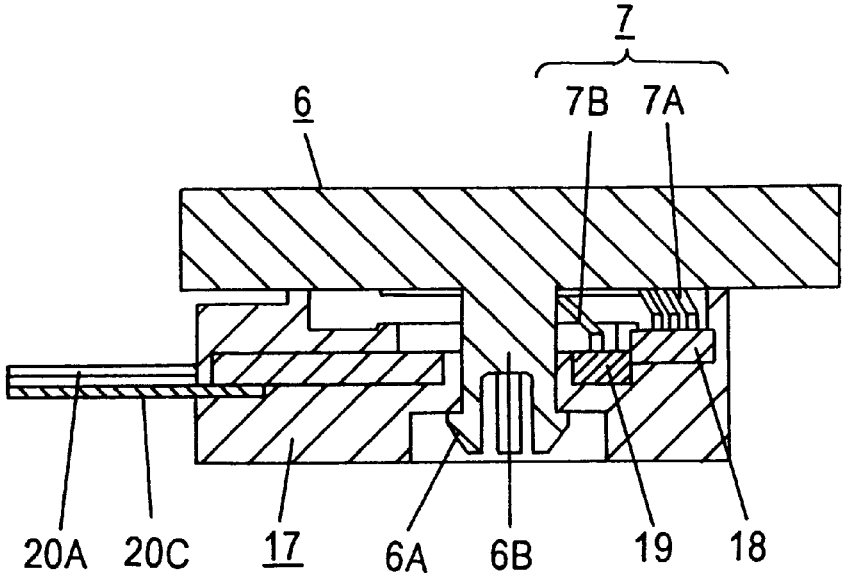
FIG. 6 is a side sectional view of a rotary manipulation type variable resistor in a second embodiment of the invention.
Figure 7:
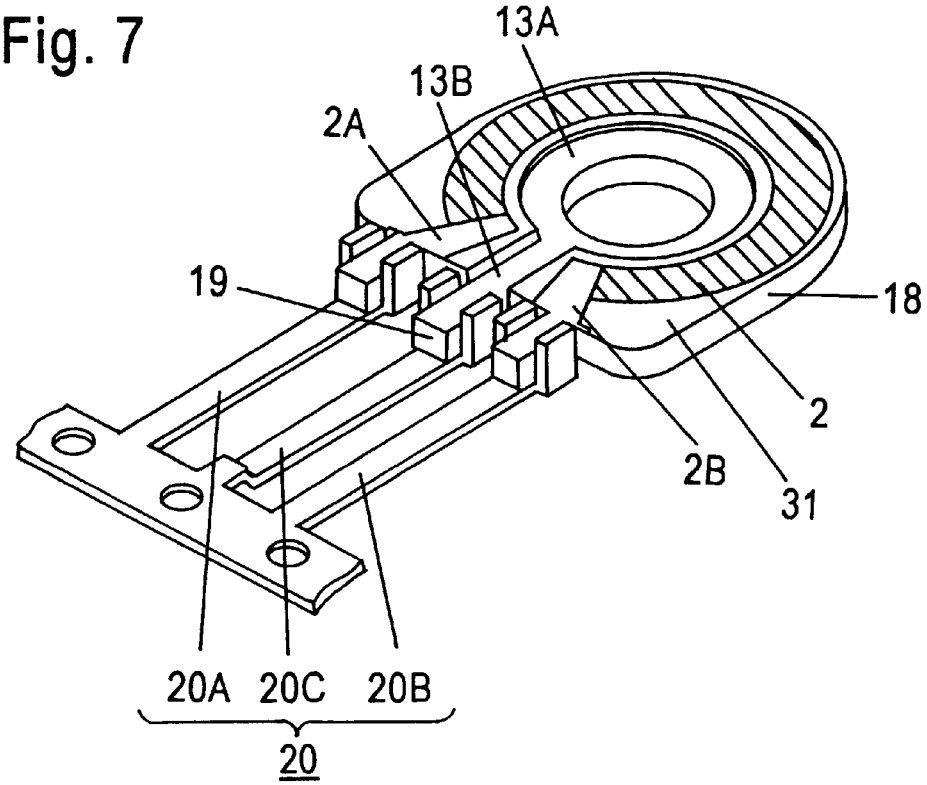
FIG. 7 is a perspective appearance of a resistance substrate and a current collector composed in the variable resistor shown in FIG. 6.
Figure 8:
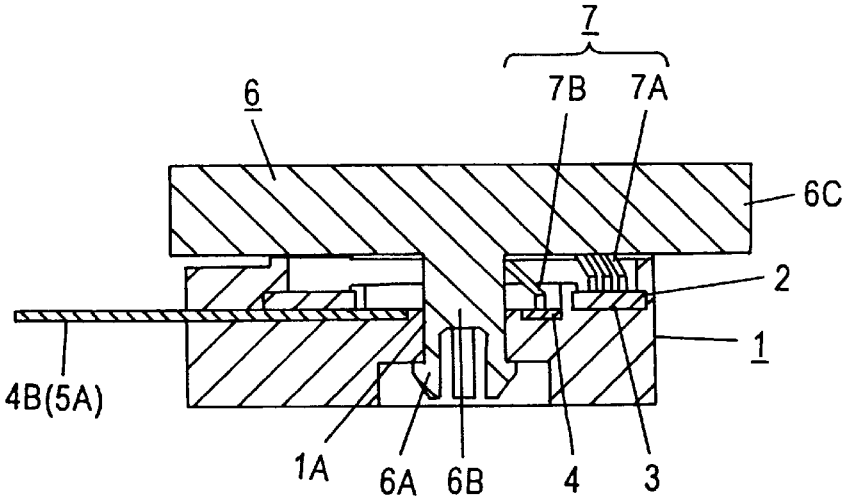
Fig. 8 PRIOR ART
FIG. 8 is a side sectional view of a conventional rotary manipulation type variable resistor.
Figure 9:
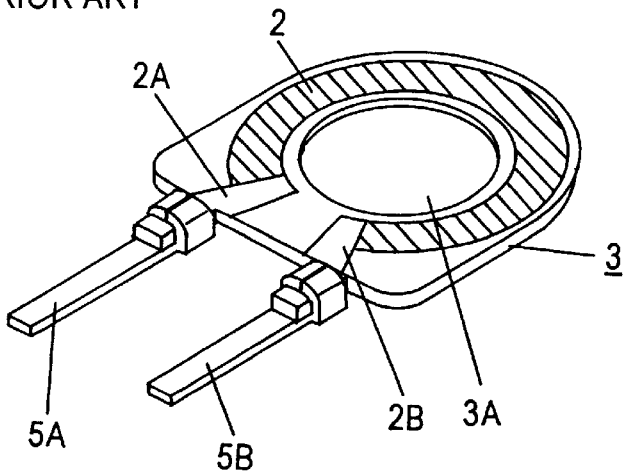
Fig. 9 PRIOR ART
FIG. 9 is a perspective appearance of a resistance substrate composed in the conventional variable resistor shown in FIG. 8.
Figure 10:
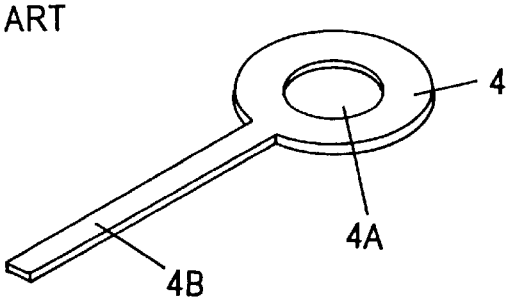
Fig. 10 PRIOR ART
FIG. 10 is a perspective appearance of a current collector composed in the conventional variable resistor shown in FIG. 8.

FIG. 6 is a side sectional view of a rotary manipulation type variable resistor according to a second embodiment of the invention, and FIG. 7 is a perspective appearance of the resistance substrate and current collector used in FIG. 6.

The rotary manipulation type variable resistor of the embodiment differs from the variable resistor in embodiment 1 in the constitution of the resistance substrate 18 and current collector 19 inserted, molded and fixed in the bottom of the case 17 made of insulating resin. The other constitution is same as in embodiment 1.

That is, (a) the step of forming the resistance substrate 18 having resistance element layer 2, first connection portion 2A and second connection portion 2B, and the current collector 19 having circular conductive layer 13A and band conductive layer 13B on the hard insulating substrate 31 is same as in the step in embodiment 1.

(b) In the step of fabricating the resistance substrate 18 and current collector 19 by blanking the insulating substrate 31 having these conductive layers, the thickness of the insulating substrate 31 used in embodiment 2 is larger than the thickness of the insulating substrate 30 used in embodiment 1. In blanking process, moreover, the current collector 19 is not completely separated from the resistance substrate 18, but in the state of the current collector 19 being depressed at a step into the blanking hole 18A in the resistance substrate 18, the current collector 19 and resistance substrate 18 are blanked in a mutually provisionally coupled state.

(c) In this provisionally coupled state, the first connection portion 2A of the resistance substrate 18 is connected to a first terminal 20A, the second connection portion 2B is crimped and connected to a second terminal 20B, and the band conductive layer 13B of the current collector 19 is crimped and connected to a third terminal 20C. Thus, the resistance substrate 18 and current collector 19 are connected to the terminal block 20.

(d) Later, the resistance substrate 18 and current collector 19 connected to the terminal block 20 are inserted and molded in resin. Thus, the case 17 fixing the resistance substrate 18 and current collector 19 is fabricated. In this case, the case 17 is fabricated so that each terminal may project outward.

The other constitution is same as in embodiment 1.

That is, (e) the first terminal 20A, second terminal 20B, and third terminal 20C are cut off and separated from each other. Thus is fabricated the case 17 fixing the resistance element layer 2 having the first terminal 20A and second terminal 20B, and the current collector 19 having the third terminal 20C.

(f) To cover the opening of the case 17 formed in this manner, a manipulation knob 6 made of insulating resin is disposed. This manipulation knob 6 is constituted same as in embodiment 1.

In this embodiment, the terminal block 20 having the first terminal 20A, second terminal 20B, and third terminal 20C may be also composed of a plurality of terminal blocks as explained in embodiment 1.

In this embodiment, the same effects as in embodiment 1 are obtained. Moreover, the manufacturing process is much simplified as compared with embodiment 1.

Thus, according to the invention, in spite of small size, the rotary manipulation type variable resistor capable of preventing electromigration when used in direct-current electric field is obtained. Moreover, the process of forming the case while inserting the resistance substrate and current collector is simplified. Further, it is not necessary to apply contact grease on the contact surface of elastic contact points. The resistance element layer and others are hardly damaged by elastic contact point.

The rotary manipulation type variable resistor having these effects simultaneously is obtained.

What is claimed is:

1. A rotary manipulation type variable resistor comprising:

(a) a resistance substrate including a first insulating substrate, a horseshoe resistance element layer, and a first connection portion and a second connection portion disposed at each of both ends of said resistance element layer, said horseshoe resistance element layer, said first connection portion and said second connection portion being disposed on said first insulating substrate, said resistance substrate having a first circular notch formed in a center and a notch formed between said first connection portion and second connection portion, said notch reaching from said first circular notch to an outer circumference of said resistance substrate, said resistance element layer being a first printing layer, and each one of said first connection portion and second connection portion being a second printing layer containing silver, (b) a current collector including a circular conductive layer, and a band conductive layer formed consecutively to said circular conductive layer, said current collector being disposed on a second insulating substrate, said current collector having a second circular notch formed in a center, each one of said circular conductive layer and said band conductive layer being a third printing layer containing silver powder and binder, and said circular conductive layer of said current collector and said resistance element layer of said resistance substrate being disposed mutually at a step, (c) a first terminal connected to said first connection portion, a second terminal connected to said second connection portion, and a third terminal connected to said band conductive layer, (d) a case accommodating said resistance substrate and current collector, said case having an opening and a penetration hole, said resistance element layer and said circular conductive layer being in said case, and each end of said first terminal, second terminal and third terminal projecting from a side face of said case, (e) a manipulation knob disposed to cover said opening, said manipulation knob having a flat part and a shaft projecting from a center of said flat part, and said shaft being inserted into said penetration hole, (f) a slider having a first contact point and a second contact point disposed on said flat part of said manipulation knob, said first contact point capable of sliding on a surface of said resistance element layer, while contacting, with said resistance element layer, and said second contact point capable of sliding on a surface of said circular conductive layer, while contacting with said circular conductive layer, and (g) wherein said first and second insulating substrates have been cut from the same insulating substrate to form complementary said first and second insulating substrates of the same material.

2. A rotary manipulation type variable resistor of claim 1, wherein said circular conductive layer of said current collector is positioned at a lower side of said first circular notch of said resistance element, and said band conductive layer is positioned at a lower side of said notch.

3. A rotary manipulation type variable resistor of claim 1, wherein at least one connection selected from the group consisting of connection between said first terminal and first connection portion, connection between said second terminal and second connection portion, and connection between said third terminal and band conductive layer is connection by crimping.

4. A rotary manipulation type variable resistor of claim 1, wherein said case is an insert molding integrally molding said resistance substrate and said current collector.

* * * * *